US006893235B2

(12) United States Patent
Furusho et al.

(10) Patent No.: US 6,893,235 B2
(45) Date of Patent: May 17, 2005

(54) SCROLL COMPRESSOR

(75) Inventors: Kazuhiro Furusho, Sakai (JP); Katsumi Kato, Sakai (JP); Hiroyuki Yamaji, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 59 days.

(21) Appl. No.: 10/476,143

(22) PCT Filed: Feb. 27, 2003

(86) PCT No.: PCT/JP03/02283

§ 371 (c)(1),
(2), (4) Date: Oct. 28, 2003

(87) PCT Pub. No.: WO03/074879

PCT Pub. Date: Sep. 12, 2003

(65) Prior Publication Data

US 2004/0156734 A1 Aug. 12, 2004

(30) Foreign Application Priority Data

Mar. 4, 2002 (JP) ..... 2002-056874

(51) Int. Cl.[7] ..... F04C 18/00
(52) U.S. Cl. ..... 418/55.5; 418/57; 418/94
(58) Field of Search ..... 418/55.5, 57, 94, 418/55.4, 55.6

(56) References Cited

U.S. PATENT DOCUMENTS 4,596,520 A * 6/1986 Arata et al. ..... 418/55.5
6,086,342 A * 7/2000 Utter ..... 418/55.5
6,135,739 A 10/2000 Ogawa et al.
6,422,843 B1 * 7/2002 Sun et al. ..... 418/55.5

FOREIGN PATENT DOCUMENTS

| | | | |
|---|---|---|---|
| JP | 60249684 A | * 12/1985 | ..... F04C/18/02 |
| JP | 61192881 A | * 8/1986 | ..... F04C/18/02 |
| JP | 5-312156 | 11/1993 | |
| JP | 8-303370 | 11/1996 | |
| JP | 8-303371 | 11/1996 | |
| JP | 11-107938 | 4/1999 | |
| JP | 2000-329075 | 11/2000 | |
| JP | 2001-214872 | 8/2001 | |

* cited by examiner

*Primary Examiner*—Theresa Trieu
(74) *Attorney, Agent, or Firm*—Shinjyu Global IP Counselors, LLP

(57) ABSTRACT

A lubrication path to press-contact surfaces of a fixed and orbiting scrolls serves also as a high-level pressure introduction passageway when a difference between a high-level pressure and a low-level pressure is great. On the other hand, when the high-level pressure introduction passageway is blocked off in a state in which the high-low pressure difference is small, refrigerating machine oil is supplied to the press-contact surfaces through a low-level pressure space within the casing, for controlling the pressing force of the orbiting scroll against the fixed scroll, and the construction for preventing a decrease in efficiency is simplified, thereby not only reducing the cost but also preventing the occurrence of a maloperation.

3 Claims, 5 Drawing Sheets

SCROLL COMPRESSOR

TECHNICAL FIELD

This invention relates to scroll compressors, and, more particularly, to technology for preventing a decrease in scroll compressor operating efficiency.

BACKGROUND ART

Scroll compressors, used as compressors for compressing refrigerant in a refrigerant circuit which executes a refrigerating cycle, have been known in the prior art (for example see Japanese Patent Kokai No. (1993)312156). As shown in FIGS. 6 and 7, such a type of scroll compressor comprises a casing housing therein a fixed and orbiting scrolls (FS, OS) whose involute wraps matingly engage with each other. The fixed scroll (FS) is secured firmly to the casing. The orbiting scroll (OS) is connected to a drive shaft. In this scroll compressor, the orbiting scroll (OS) executes an orbital motion relative to the fixed scroll (FS) by rotation of the drive shaft. The volume of a compression chamber defined between the wraps varies, and the suction, compression, and discharge of refrigerant are carried out repeatedly.

Incidentally, the orbiting scroll (OS) receives a thrust load PS which is an axial force and a radial load PT which is a radial force, when refrigerant is compressed (see FIG. 6). To cope with this, the scroll compressor employs a construction in which a high-level pressure part (P) is provided to apply a high-level refrigerant pressure onto the back surface (lower surface) of the orbiting scroll (OS), whereby the orbiting scroll (OS) is pressed against the fixed scroll (FS) in opposition to the axial force PS by that high-level pressure.

In such an arrangement, if a pressing force PA of the orbiting scroll (OS) is small, and if the vector of a resultant force acting on the orbiting scroll (OS) passes outside the outer periphery of a thrust bearing, the orbiting scroll (OS) is inclined or overturned by the action of a so-called upsetting moment. As a result, there occurs refrigerant leakage, thereby resulting in a decrease in efficiency. By contrast to this, if the pressing force of the orbiting scroll (OS) is greatened, and if the vector of a resultant force acting on the orbiting scroll (OS) is made to pass inside the outer periphery of the thrust bearing, this makes it possible to prevent the orbiting scroll (OS) from overturning.

On the other hand, if there is a change in operating condition of a refrigerating apparatus employing a scroll compressor of the foregoing type thereby causing a variation in high- or low-level pressure, this causes the difference between high-level pressure and low-level pressure (hereinafter the high-low pressure difference) to vary. Consequently, the pressing force PA by the refrigerant pressure of the back surface of the orbiting scroll (OS) varies extensively, particularly with the change in high-level pressure, resulting in an excess or deficiency of the pressing force PA.

In other words, if the area of the high pressure part (P) by which a high-level pressure acts on the orbiting scroll (OS) is such set that the orbiting scroll (OS) does not overturn in the condition in which the high-low pressure difference is great, this leads to deficiency in pressing force because the high-level pressure decreases for example when the high-low pressure difference is small. As a result, the orbiting scroll (OS) is likely to overturn. On the other hand, conversely, if the area of the high pressure part (P) is set according to the condition in which the high-low pressure difference is small, the pressing force of the orbiting scroll (OS) against the fixed scroll (FS) becomes excessive with respect to a minimum required pressing force, for example when the high-low pressure difference becomes great because the high-level pressure increases. As a result, a great thrust force acts on the orbiting scroll (OS) in an upward direction. Accordingly, mechanical loss increases and there is a drop in efficiency.

PROBLEMS THAT INVENTION INTENDS TO SOLVE

As a solution to such a problem, the applicant of the present application proposed a scroll compressor in Japanese Patent Application No. 2000-088041 (Japanese Patent Kokai No. 2001-214872). In this scroll compressor, refrigerating machine oil at a high-level pressure is introduced between a fixed scroll (FS) and an orbiting scroll (OS) when the high-low pressure difference is great, whereby the orbiting scroll (OS) is pushed back by a force PR in opposition to the pressing force PA. On the other hand, when the high-low pressure difference is small, introduction of high-level pressure refrigerating machine oil between the fixed scroll (FS) and the orbiting scroll (OS) is interrupted to bring push back operation to a halt. In accordance with the construction of this patent application (which is schematically shown in FIG. 7), the flow of refrigerating machine oil is controlled by provision of a high-level pressure introduction pathway (P) with a control valve (V) capable of selective switching according to the size of high-low pressure difference, thereby making it possible to prevent both excessive pressing of the orbiting scroll (OS) when the high-low pressure difference is great and insufficient pressing of the orbiting scroll (OS) when the high-low pressure difference is small.

The above-described construction, although it is capable of eliminating the problems with the pressing force of the orbiting scroll (OS), still suffers some problems. One problem is that the provision of the high-level pressure introduction pathway (P) dedicated to introduce refrigerating machine oil between the fixed scroll (FS) and the orbiting scroll (OS) makes the construction complicated, and the cost might increase. On the other hand, this problem can be eliminated, for example by employing such an arrangement that the high-level pressure introduction pathway serves also as a lubrication path to press-contact surfaces of the scrolls. This, however, means that when the high-level pressure introduction pathway is closed at the time when the high-low pressure difference is small, the lubrication path is also brought into the closed state. This might cause maloperation of the scroll compressor due to deficiency in the supply of lubricant to movable parts thereof.

Bearing in mind these problems, the present invention was created. Accordingly, an object of the present invention is to cut costs by simplifying the construction of a scroll compressor of the type in which the pressing force of an orbiting scroll against a fixed scroll is controlled, and to prevent maloperation of the scroll compressor.

DISCLOSURE OF INVENTION

In the present invention, it is arranged such that a lubrication path to press-contact surfaces of a fixed and orbiting scrolls is used as a high-level pressure introduction pathway when the high-low pressure difference is great and, when the high-level pressure introduction pathway is blocked off at the time when the high-low pressure difference is small, a supply of refrigerating machine oil is provided to the press-contact surfaces from the lubrication path through a low-level pressure space within the casing.

More specifically, the present invention is directed to a scroll compressor comprising a casing (10) housing a compression mechanism (20) including a fixed and orbiting scrolls (21, 22) having respective involute wraps which matingly engage with each other and respective press-contact surfaces which press-contact each other in an axial direction, and a drive mechanism (30) coupled, through a drive shaft (34), to the orbiting scroll (22).

The invention of claim 1 further includes a press-contact surface lubrication path (50) which is formed in the orbiting scroll (22) so as to communicate with the presscontact surfaces from a main lubrication path (36) formed in the drive shaft (34), and the press-contact surface lubrication path (50) comprises: a first pathway **(50*a*) which communicates with the press-contact surfaces from the inside of the orbiting scroll (22); a second pathway (50*b*) which communicates with the press-contact surfaces through a low-level pressure space (S1) of the casing (10); and a lubrication control mechanism (60) which opens the first pathway (50*a*) and closes the second pathway (Sob) when a difference between a high-level pressure and a low-level pressure within the casing (10) exceeds a predetermined value, and which closes the first pathway (50*a*) and opens the second pathway (50*b*)** when the high-low pressure difference is equal to or less than the predetermined value.

In this arrangement, when the high-low pressure difference exceeds the predetermined value there is made a supply of refrigerating machine oil to the presscontact surfaces through the first pathway **(50*a*) of the press-contact surface lubrication path (50). In other words, refrigerating machine oil at a high-level pressure is supplied to the press-contact surfaces from the inside of the orbiting scroll (22), without change in its pressure level. Accordingly, it becomes possible to provide a force which causes the orbiting scroll (22) to be pushed back from the fixed scroll (21) in opposition to the pressing force of the orbiting scroll (22) against the fixed scroll (21)**.

On the other hand, when the high-low pressure difference is equal to or less than the predetermined value, the second pathway **(50*b*) is brought into the open state. Accordingly, refrigerating machine oil flows out from the press-contact surface lubrication path (50), enters the low-level pressure space (S1) of the casing (10), and is supplied to between the fixed scroll (21) and the orbiting scroll (22) from the low-level pressure space (S1). In this case, it is possible to provide a supply of refrigerating machine oil at a low-level pressure, thereby making it possible to eliminate creation of a force which causes the orbiting scroll (22) to be pushed back from the fixed scroll (21)**. From the above, neither excessive pressing when the high-low pressure difference is great nor insufficient pressing when the high-low pressure difference is small will take place.

The invention of claim 2 is a scroll compressor according to the invention of claim 1. The scroll compressor of claim 2 is characterized as follows. The press-contact surface lubrication path (50) comprises a main body passageway (51) which is formed in the inside of the orbiting scroll (22) so as to open to the main lubrication path's (32) side and to the low-level pressure space's (S1) side, a first branch passageway (52) which communicates with the press-contact surfaces of the scrolls (21, 22) from the main body passageway (51), and a second branch passageway (53) which communicates with the low-level pressure space (S1) from the main body passageway (51). The lubrication control mechanism (60) comprises a valve element (61) which is disposed movably within the main body passageway (51). The valve element (61) travels to a first position when the high-low pressure difference exceeds the predetermined value, whereby the first branch passageway (52) is opened and the second branch passageway (53) is closed, and the valve element (61) travels to a second position when the high-low pressure difference is equal to or less than the predetermined value, whereby the first branch passageway (52) is closed and the second branch passageway (53) is opened.

Stated another way, in this arrangement the first pathway **(50*a*) is made up of the main body passageway (51) and the first branch passageway (52), and the second pathway (50*b*) is made up of the main body passageway (51) and the second branch passageway (53). The first pathway (50*a*) and the second pathway (50*b*) are switched by the movement of the valve element (61)**.

As a result of such arrangement, when the high-low pressure difference exceeds the predetermined value the valve element (61) of the lubrication control mechanism (60) travels to the first position and the press-contact surface lubrication path (50) is brought into communication with the press-contact surfaces by the first pathway **(50*a*). Accordingly, refrigerating machine oil at a high-level pressure is introduced to the presscontact surfaces, thereby making it possible to cause a press-back force to act against a force which presses the orbiting scroll (22) against the fixed scroll (21). Additionally, when the high-low pressure difference is equal to or less than the predetermined value the valve element (61) of the lubrication control mechanism (60) travels to the second position and the lubrication path (50) is brought into communication with the low-level pressure space (S1) by the second pathway (50*b*). Accordingly, the refrigerating machine oil which has now become low in pressure is supplied to between the fixed scroll (21) and the orbiting scroll (22) from the low-level pressure space (S1) and substantially no force which pushes back the orbiting scroll (22) acts in opposition to a force which presses the orbiting scroll (22) against the fixed scroll (21)**.

The invention of claim 3 is a scroll compressor according to the invention of claim 2. The scroll compressor of claim 3 is characterized as follows. The lubrication control mechanism (60) comprises a biasing means (62) for biasing the valve element (61) to the second position within the main body passageway (51), and the biasing force of the biasing means (62) is such set that the valve element (61) is held at the second position when the highlow pressure difference is equal to or less than the predetermined value, and that the valve element (61) is allowed to travel to the first position when the high-low pressure difference exceeds the predetermined value.

As a result of such arrangement, the valve element (61) of the lubrication control mechanism (60) is controlled, by high-low pressure difference and the biasing force of the biasing means (62), such that it travels to the first or second position. In other words, when the high-low pressure difference exceeds the predetermined value and becomes superior to biasing force, the valve element (61) travels to the first position and a force which pushes back the orbiting scroll (22) is produced. On the other hand, when the high-low pressure difference is equal to or less than the predetermined value and becomes inferior to biasing force, the valve element (61) travels to the second position and no force which pushes back the orbiting scroll (22) is produced.

EFFECTS

In accordance with the invention as set forth in claim 1, when the high-low pressure difference exceeds the predetermined value, a force which pushes back the orbiting scroll (22) acts in opposition to a force which presses the orbiting scroll (22) against the fixed scroll (21), whereby excessive pressing is suppressed. On the other hand, when the highlow pressure difference is equal to or less than the predetermined value, there is no application of a force which pushes back the orbiting scroll (22) away from the fixed scroll (21) and therefore deficient pressing will not take place. In this way, it is possible to prevent a decrease in efficiency by controlling the pressing force of the orbiting scroll (22) against the fixed scroll (21).

Furthermore, since the lubrication path (50) is used for control of the pressing force of the orbiting scroll (22) against the fixed scroll (21), this eliminates the need for the provision of a dedicated high-level pressure introduction pathway in addition to the lubrication path (50). Accordingly, this prevents the construction from becoming complicated, thereby making it possible to cut down the cost.

Additionally, since it is arranged such that there is a supply of refrigerating machine oil to the press-contact surfaces from the low-level pressure space (S1) when the high-low pressure difference is small, this avoids the occurrence of a maloperation due to poor lubrication.

In accordance with the invention as set forth in claim 2, the lubrication control mechanism (60) composed of the movable valve element (61) is disposed in the press-contact surface lubrication path (50) of the orbiting scroll (22) and the lubrication path (50) switches between the first pathway (50*a*) and the second pathway (50*b*) according to the position of the valve element (61), thereby making it possible to adjust the pressing force of the orbiting scroll (22) against the fixed scroll (21) with an extremely simple construction.

In accordance with the invention as set forth in claim 3, the valve element (61) is biased to the second position by a biasing means such as the compression coil spring (62) and it is arranged such that the valve element (61) travels to the first position only when the pressure difference becomes superior to a biasing force, thereby making it possible to adjust the pressing force of the orbiting scroll (22) against the fixed scroll (21) by controlling the position of the valve element (61) by a simple construction.

BEST MODE FOR CARRYING OUT INVENTION

Hereinafter, an embodiment of the present invention will be described in detail by making reference to the drawings.

Figure 1:
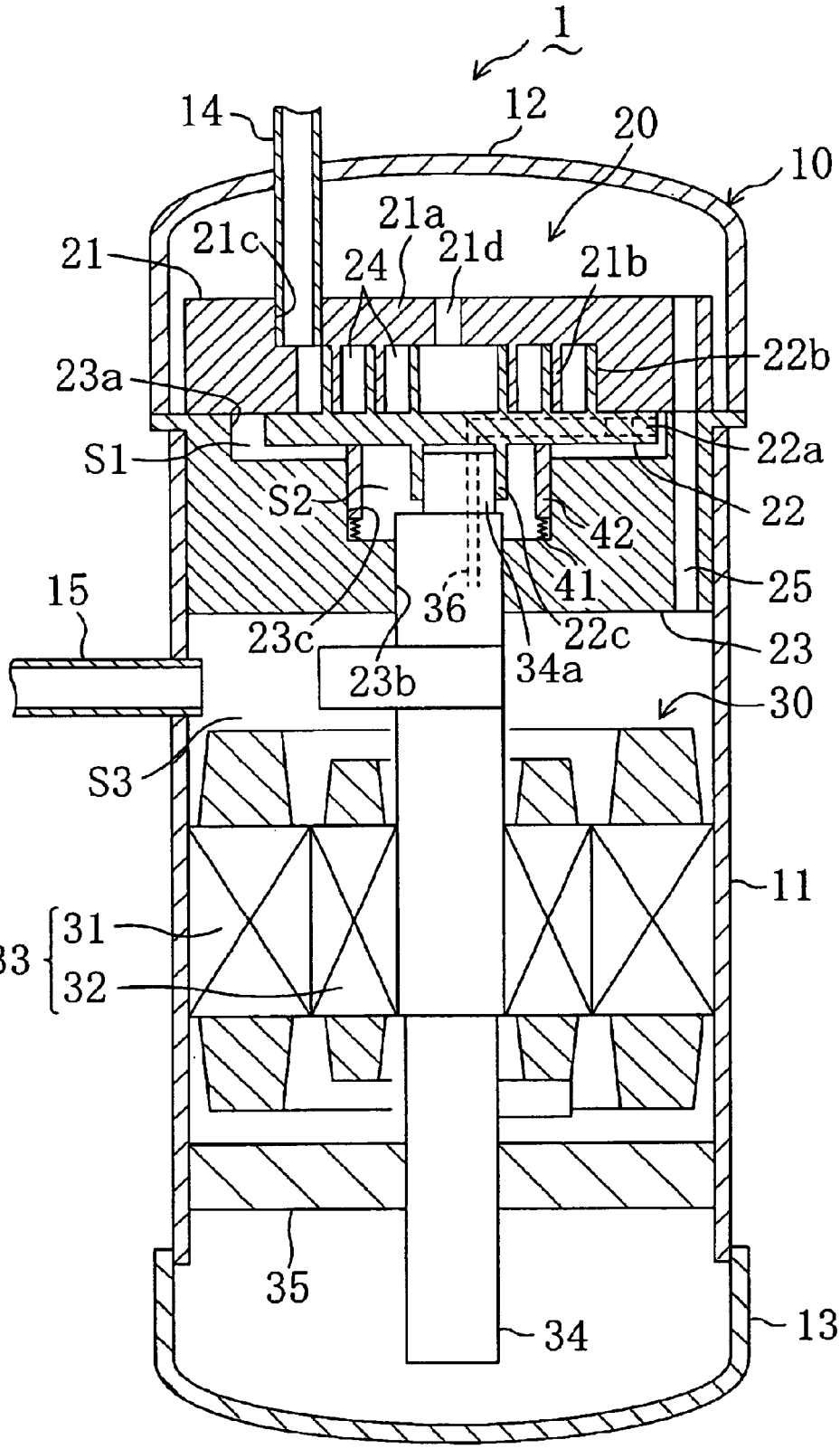
FIG. 1 is a diagram showing a cross-sectional construction of a scroll compressor according to a first embodiment of the present invention.
Figure 2:
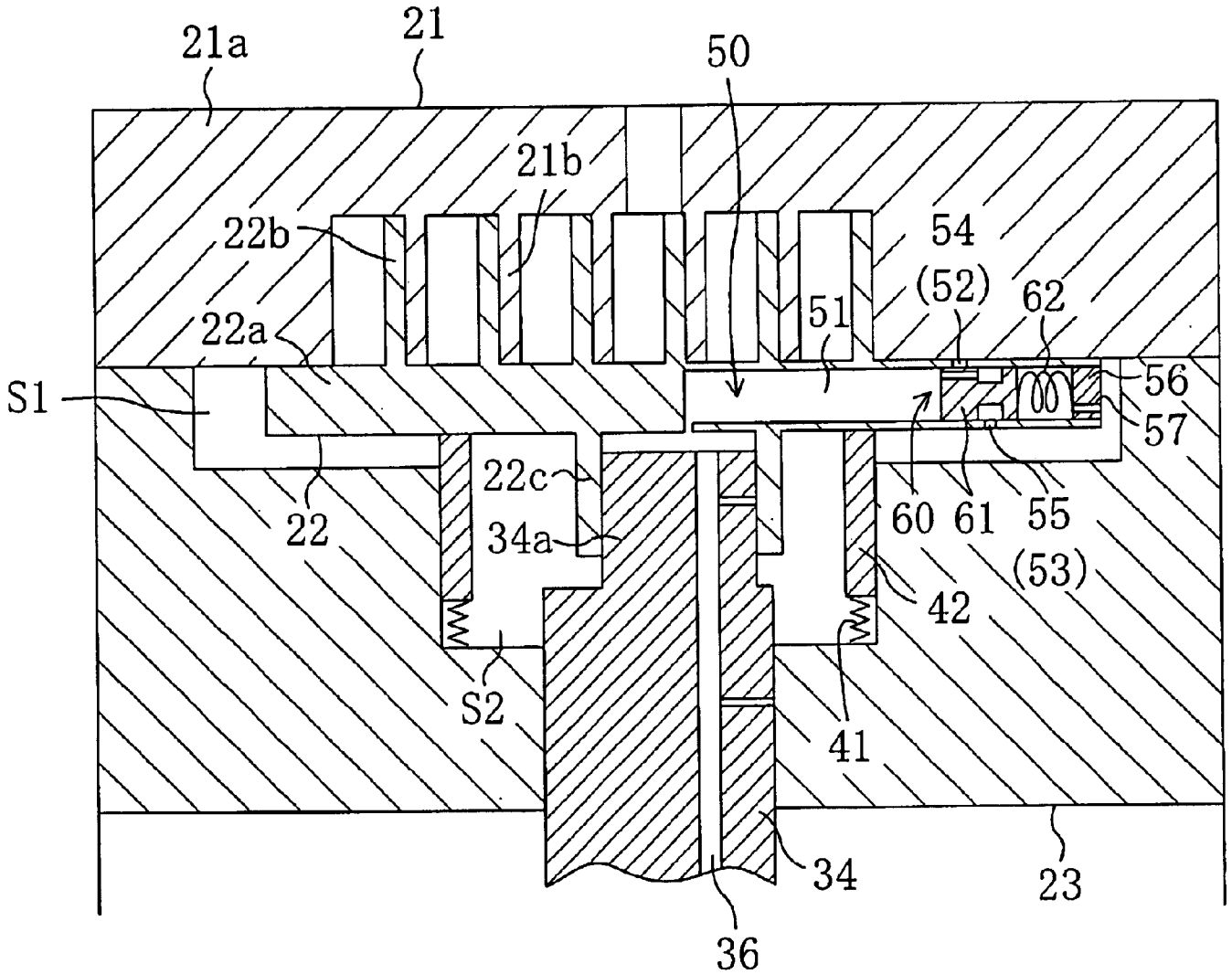
FIG. 2 is a partially enlarged diagram of FIG. 1.

FIG. 1 is a longitudinal cross-sectional view showing a construction of a scroll compressor (1) according to the present embodiment. FIG. 2 is a partially enlarged view of FIG. 1. The scroll compressor (1) is used to compress a low-level pressure refrigerant drawn in from an evaporator and discharge it to a condenser, in a refrigerant circuit of a refrigerating apparatus, such as an airconditioner and the like, which executes a vapor compression refrigerating cycle. As shown in FIG. 1, the scroll compressor (1) comprises a casing (10) housing therein a compression mechanism (20) and a drive mechanism (30) for driving the compression mechanism (20). The compression mechanism (20) is disposed at an upper part of the inside of the casing (10). The drive mechanism (30) is disposed at a lower part of the inside of the casing (10).

The casing (10) is made up of a trunk part (11) shaped like a cylinder and dishshaped end plates (12, 13) which are secured firmly to an upper and lower ends of the trunk part (11), respectively. The upper end plate (12) is secured firmly to a frame (23) which is secured firmly to the upper end of the trunk part (11). The frame (23) will be described later. The lower end plate (13) is secured engagingly and firmly to a lower end part of the trunk part (11).

The drive mechanism (30) is made up of a motor (33) including a stator (31) secured firmly to the trunk part (11) of the casing (10) and a rotor (32) disposed in the inside of the stator (31), and a drive shaft (34) secured firmly to the rotor (32) of the motor (33). The drive shaft (34) is connected, at an upper end part (34*a*) thereof, to the compression mechanism (20). On the other hand, a lower end part of the drive shaft (34) is rotatably supported by a bearing member (35) secured firmly to the lower end part of the trunk part (11) of the casing (10).

The compression mechanism (20) has, in addition to the frame (23), a fixed scroll (21) and an orbiting scroll (22). As described above, the frame (23) is secured firmly to the trunk part (11) of the casing (10). The frame (23) divides the internal space of the casing (10) into an upper and lower spaces.

The fixed scroll (21) is made up of an end plate (21*a*) and an involute wrap (21*b*) formed in a lower surface of the end plate (21*a*). The end plate (21*a*) of the fixed scroll (21) is secured firmly to the frame (23) and becomes integrated with the frame (23). The orbiting scroll (22) is made up of an end plate (22*a*) and an involute wrap (22*b*) formed in an upper surface of the end plate (22*a*).

The wrap (21*b*) of the fixed scroll (21) and the wrap (22*b*) of the orbiting scroll (22) matingly engage with each other. Between the end plate (21*a*) of the fixed scroll (21) and the end plate (22*a*) of the orbiting scroll (22), a clearance between contacting parts of the wraps (21*b*, 22*b*) is formed as a compression chamber (24). This compression chamber (24) is such configured that refrigerant is compressed when the volume between the wraps (21*b*, 22*b*) shrinks toward the center as the orbiting scroll (22) moves around the drive shaft (34).

In the end plate (21*a*) of the fixed scroll (21), a suction opening (21*c*) for low-level pressure refrigerant is formed on the periphery of the compression chamber (24) and a discharge opening (21*d*) for high pressure level refrigerant is formed centrally in the compression chamber (24). Connected to the refrigerant suction opening (21*c*) is a suction pipe (14) which is secured firmly to the upper end plate (12) of the casing (10). The suction pipe (14) is connected to an evaporator of the refrigerant circuit (not shown). On the other hand, a circulation path (25) for guiding high-level pressure refrigerant to below the frame (23) is so formed as to vertically pass through the end plate (21*a*) of the fixed scroll (21) and the frame (23). A discharge pipe (15) through which refrigerant at a high-level pressure is discharged is secured firmly to a central part of the trunk part (11) of the casing (10) and is connected to a condenser of the refrigerant circuit (not shown).

A boss (22*c*) is formed in the lower surface of the end plate (22*a*) of the orbiting scroll (22). The upper end part (34*a*) of the drive shaft (34) is connected to the boss (22*c*). The upper end part of the drive shaft (34) is an eccentric shaft portion (34) deviating from the rotational center of the drive shaft (34) so that the orbiting scroll (22) revolves relative to the fixed scroll (21). A rotation preventing member (not shown) such as an Oldham mechanism is disposed between the end plate (22*a*) of the orbiting scroll (22) and the frame (23) so that the orbiting scroll (22) does not rotate on its axis but executes only an orbital motion.

A main lubricant path (36) extending in axial direction is formed in the drive shaft (34). In addition, a centrifugal pump (not shown) is disposed in a lower end part of the drive shaft (34) and draws refrigerating machine oil stored in a bottom part of the casing (11) with revolutions of the drive shaft (34). The main lubrication path (36) extends vertically in the inside of the drive shaft (34) and communicates with lubrication openings formed in respective parts so that the refrigerating machine oil drawn by the centrifugal pump is supplied to each sliding part.

In the present embodiment, the pressure of refrigerant at a high-level pressure and the pressure of refrigerating machine oil are utilized to press the orbiting scroll (22) against the fixed scroll (21) so that the end plates (21*a*, 22*a*) press-contact each other in axial direction, and such a pressing force is controlled to the variation in high-low pressure difference with the change in operating condition of an airconditioner or the like (such as the increase in high-level pressure). Here, a construction for pressing the orbiting scroll (22) against the fixed scroll (21) and a construction for controlling such a pressing force will be described below.

In the first place, a first recessed part (23*a*) which is somewhat greater than the operating range of the orbiting scroll (22) is formed in the upper surface of the frame (23). In addition, centrally formed in the lower surface of the frame (23) is a bearing aperture (23*b*) into which the drive shaft (34) is rotatably interfit, and a second recessed part (23*c*) having a diameter intermediate between the first recessed part (23*a*) and the bearing aperture (23*b*) is formed between the first recessed part (23*a*) and the bearing aperture (23*b*). An annular seal member (42) which is press-contacted with the back surface (lower surface) of the end plate (22*a*) of the orbiting scroll (22) by a spring (41), is interfit into the second recessed part (23*c*).

The back surface side (lower surface side) of the orbiting scroll (22) is divided into a first space (S1) on the outer-diameter side of the seal member (42) and a second space (S2) on the inner diameter side thereof. The second space (S2) communicates with a high-level pressure space in the inside of the casing (10) (not shown) and is filled with a high-level pressure refrigerant. On the other hand, a minute groove is formed, along the radial direction, in the lower surface of the end plate (21*a*) of the fixed scroll (21), whereby the suction side of the compression (24) and the first space (S1) communicate each other, and the first space (S1) is held at a low-level pressure by this minute groove. As a result of such arrangement, the second space (S2) constitutes a high-level pressure space by which the high-level pressure of refrigerant acts on the back surface (lower surface) of the end plate (22*a*) of the orbiting scroll (22), and the first space (S1) constitutes a low-level pressure space.

In the next place, a construction for suppressing the pressing force of the orbiting scroll (22) against the fixed scroll (21) when the high-low pressure difference exceeds a predetermined value in the scroll compressor (1) of the present embodiment, will be described below.

As shown in FIG. 2, a press-contact surface lubrication path (50) is formed in the orbiting scroll (22) so as to communicate with the press-contact surfaces of the fixed and orbiting scrolls (21, 22) from the main lubrication path (36). The press-contact surface lubrication path (50) includes a main body passageway (51) formed in the inside of the end plate (22*a*) of the orbiting scroll (22) and extending from the central side to the outer peripheral side thereof along a radial direction, a first small aperture (54) constituting a first branch passageway (52) communicating with the press contact surfaces of the scrolls (21, 22) from the main body passageway (51), and a second small aperture (55) constituting a second branch passageway (53) communicating with the low-level pressure space from the main body passageway (51). The first small aperture (54) is formed in the upper surface of the orbiting scroll (22) so that the press-contact surface lubrication path (50) and the press-contact surfaces are brought into communication with each other. In addition, the second small aperture (55) is formed in the lower surface of the orbiting scroll (22) so that the press-contact surface lubrication path (50) and the first space (S1) are brought into communication with each other.

In addition, it is advisable to employ such an arrangement that an annular groove (not shown) is formed for example in the upper surface of the orbiting scroll (22) and a part of the groove is brought into communication with the main body passageway (51) through the first small aperture (54). Furthermore, such an annular groove may be formed on the side of the fixed scroll (21). However, the annular groove does not have to be in the form of a groove. Any form may be employed as long as pressure acts between the orbiting scroll (22) and the fixed scroll (21).

The main body passageway (51) is such formed that it communicates with both the main lubrication path's (36) side and the first space's (S1) side. Stated another way, one end of the main body passageway (51) opens to the lower surface of the orbiting scroll (22) on the inner-diameter side of the boss (22*c*) and, on the other hand, the other end of the main body passageway (51) opens to the first space (S1) through a third small aperture (57) of a plug (56) disposed at an outer peripheral edge of the orbiting scroll (22).

Figure 4:
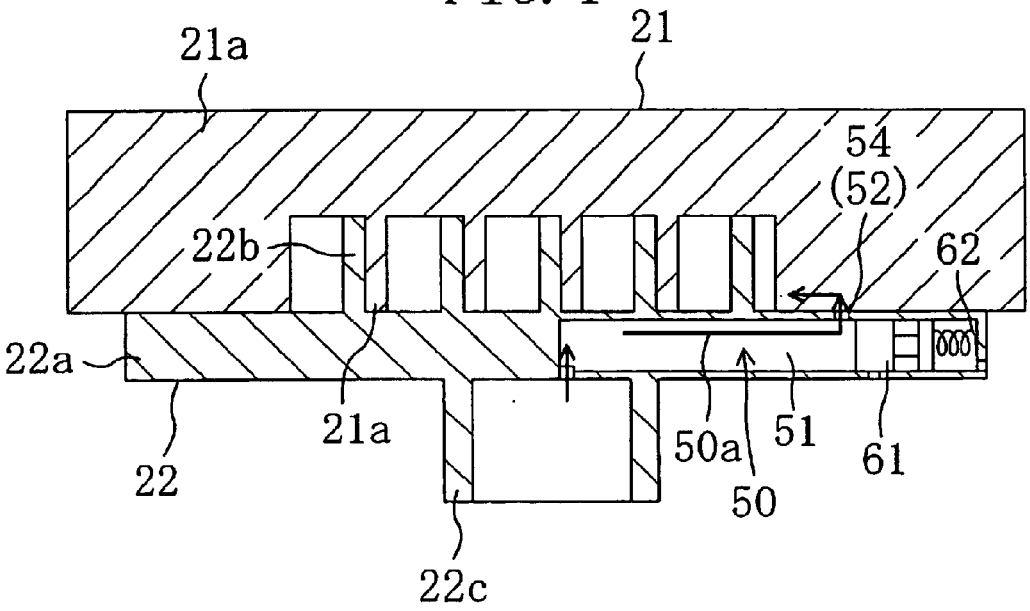
FIG. 4 is a cross-sectional view showing a first state of a lubricant control mechanism.
Figure 5:
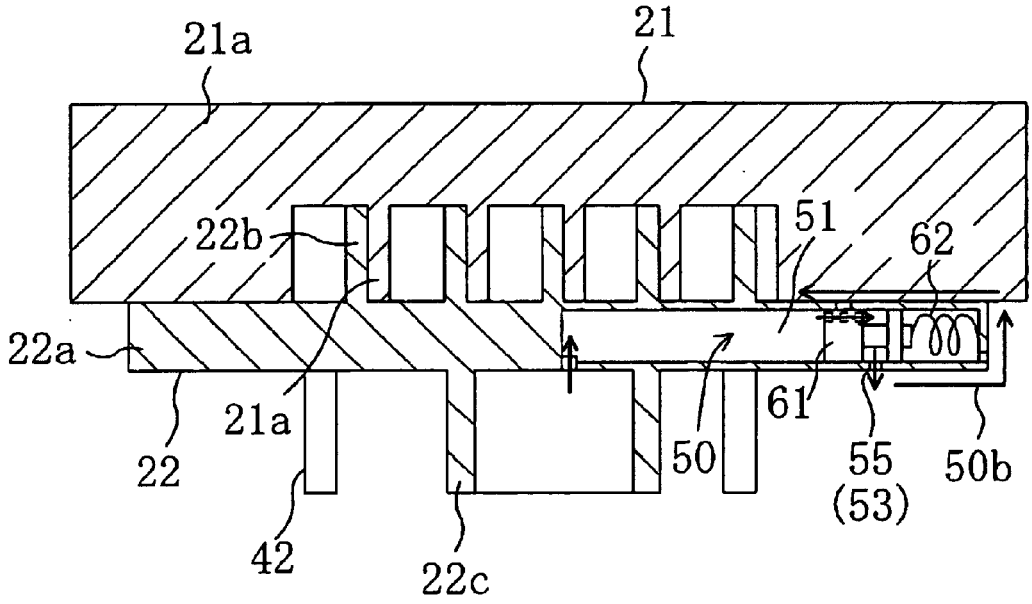
FIG. 5 is a cross-sectional view showing a second state of the lubricant control mechanism.
Figure 6:
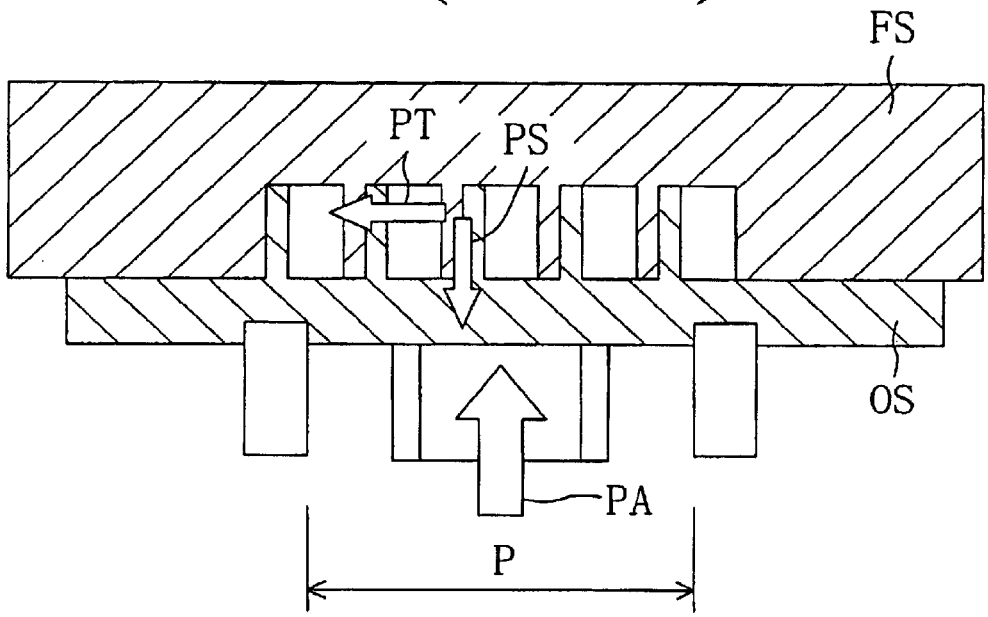
FIG. 6 (Prior Art)
FIG. 6 is a first cross-sectional view illustrating the action of forces against an orbiting scroll in a conventional scroll compressor.
Figure 7:
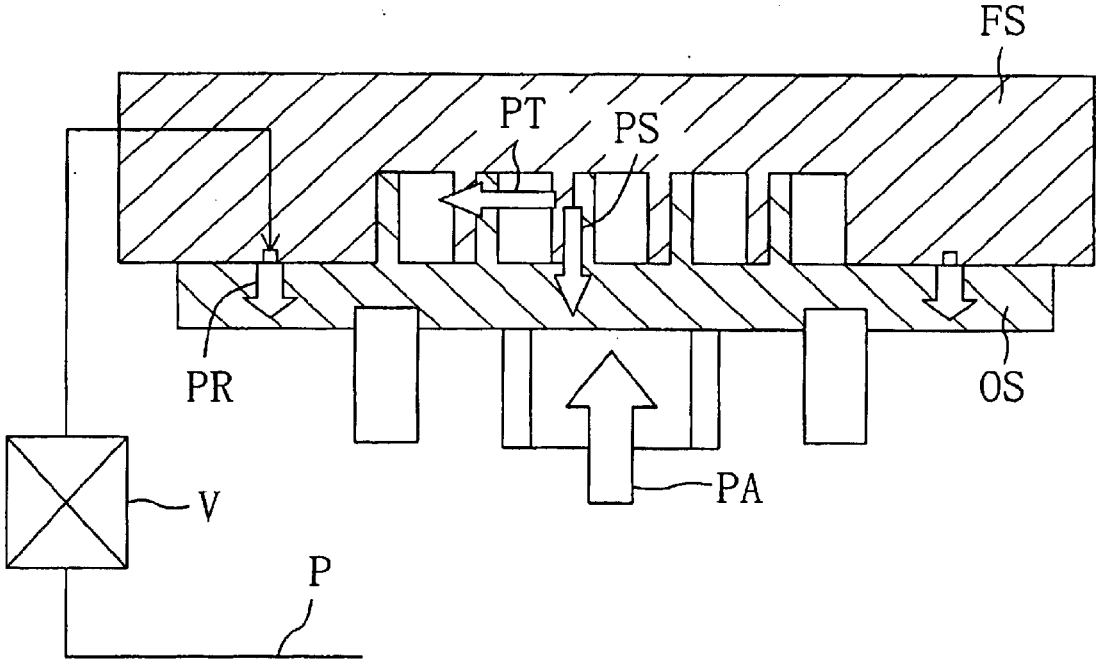
FIG. 7 (Prior Art)
FIG. 7 is a second cross-sectional view illustrating the action of forces against the orbiting scroll in the conventional scroll compressor.

As shown in FIG. 4, the main body passageway (51) and the first branch passageway (52) together constitute a first pathway (50*a*) which passes through the inside of the orbiting scroll (22) to communicate with the press-contact surfaces from the main lubrication path (36), and, as shown in FIG. 5, the main body passageway (51) and the second branch passageway (53) together constitute a second pathway (50*b*) which communicates with the press-contact surfaces from the main lubrication path (36) through the low-level pressure space of the casing (10).

In addition, the press-contact surface lubrication path (50) is provided with a lubrication control mechanism (60). The lubrication control mechanism (60) opens the first pathway (50*a*) and closes the second pathway (50*b*) when the high-low pressure difference in the inside of the casing (10) exceeds a predetermined value. On the other hand, when the high-low pressure difference is equal to or less than the predetermined value, the lubrication control mechanism (60) closes the fist pathway (50*a*) and opens the second pathway (Sub). Refrigerating machine oil is supplied, directly or by way of the first space (S1), to the press-contact surfaces by switching the lubrication control mechanism (60).

The lubrication control mechanism (60) is composed of a valve element (61) disposed movably within the main body pathway (51). The valve element (61) is constructed as follows. That is, when the high-low pressure difference exceeds a predetermined value, the valve element (61) moves to a first position (see FIG. 4), whereby the first branch passageway (52) is opened and the second branch passageway (53) is closed. On the other hand, when the high-low pressure difference is equal to or less than the predetermined value, the valve element (61) moves to a second position (see FIG. 5), whereby the first branch passageway (52) is closed and the second branch passageway (53) is opened.

To this end, the lubrication control mechanism (60) is provided with a compression coil spring (62) serving as a biasing means for biasing the valve element (61) to the second position within the main body pathway (51). The biasing force of the compression coil spring (62) is such set that the valve element (61) is held in the second position when the high-low pressure difference is equal to or less than the predetermined value, and that the valve element (61) is allowed to move to the first position when the high-low pressure difference exceeds the predetermined value.

Figure 3:
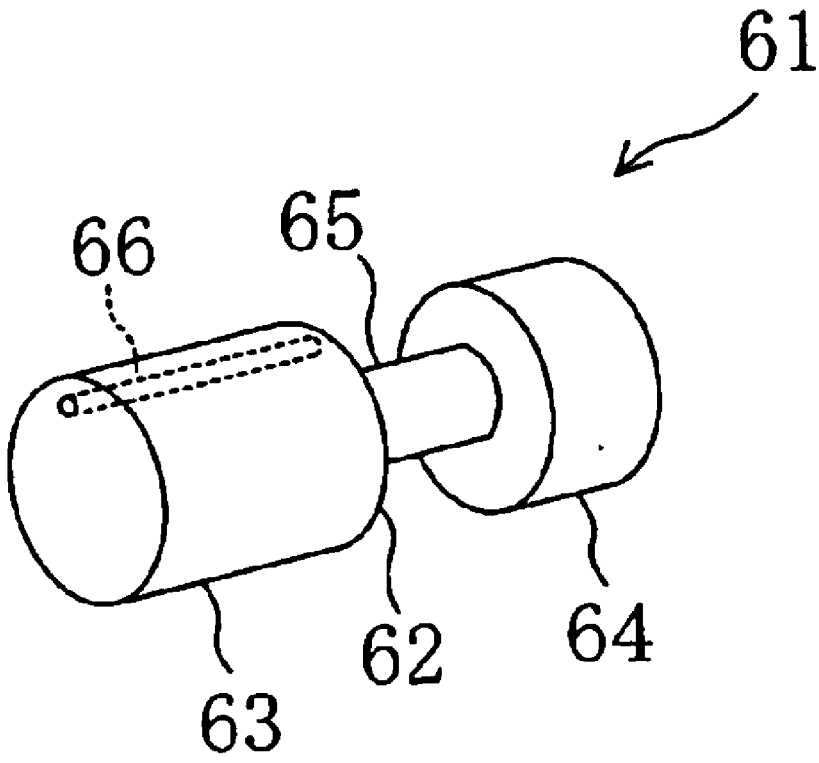
FIG. 3 is an enlarged perspective view of a valve element.

Additionally, the whole of the valve element (61) is shaped substantially like a cylinder, as perspectively shown in FIG. 3, and a peripheral groove (62) is formed in a part of the outer peripheral surface of the cylindrical valve element (61), continuously extending in the peripheral direction. A small-diameter part (65) lies interposingly between a first great-diameter part (63) and a second great-diameter part (64). When the valve element (61) assumes the second position (FIG. 5), the first great-diameter part (63) closes the first small aperture (54) and, at the same time, the peripheral groove (62) communicates with the second small aperture (55). On the other hand, when the valve element (61) assumes the first position (FIG. 4), the first great-diameter part (63) opens the first small aperture (54) while closing the second small aperture (55). A small aperture (66) is formed in the first great-diameter part (63) of the valve element (61), communicating together an end surface of the first great-diameter part (63) located opposite to the second great-diameter part (64), and the peripheral groove (62).

RUNNING OPERATION

Next, the running operation of the scroll compressor (1) will be described.

When the motor (33) is activated, the rotor (32) rotates relative to the stator (31), thereby causing the drive shaft (34) to rotate. When the drive shaft (34) rotates, the eccentric shaft portion (34*a*) revolves around the rotational center of the drive shaft (34) and the orbiting scroll (22) executes only an orbiting motion with respect to the fixed scroll (21) without rotating on its axis. As a result of this, a refrigerant at a low-level pressure is drawn into a peripheral edge part of the compression chamber (24) from the suction pipe (14). The drawn refrigerant is compressed as the volume of the compression chamber (24) varies. The refrigerant is compressed to a high level pressure and is discharged to above the fixed scroll (21) from the discharge opening (21*d*) located centrally in the compression chamber (24).

The refrigerant flows through the circulation path (25) formed through the fixed scroll (21) and through the frame (23) and flows into below the frame (23). The high-level pressure refrigerant fills up the inside of the casing (10) while being discharged from the discharge pipe (15). The refrigerant is subjected to a condensation process, an expansion process, and an evaporation process in the refrigerant circuit. Thereafter, the refrigerant is drawn in again from the suction pipe (14) and is compressed.

On the other hand, during operation, the pressure level of refrigerating machine oil stored within the casing (10) also becomes high. This refrigerating machine oil is supplied, through the lubrication path within the drive shaft (34), to each sliding part by centrifugal pump (not shown). The inside of the second space (S2) is filled with the high-level pressure refrigerant within the casing (10). Accordingly, the orbiting scroll (22) is pressed, from the back surface (lower surface) side thereof, against the fixed scroll (21) by the high-level pressure refrigerant, thereby preventing the orbiting scroll (22) from inclining or overturning. In addition, the area of the orbiting scroll (22) on which refrigerant at a high-level pressure acts is set to such a degree that the orbiting scroll (22) does not overturn in an operating condition that the high-low pressure difference is relatively small.

On the other hand, when, for example, the increase in high-level pressure by a change in operating condition extends the high-low pressure difference, the pressing force of the orbiting scroll (22) against the fixed scroll (21) grows greater. Additionally, both a force produced by the high-level pressure and a force obtained from a pressure of the low-level pressure space (S1) and a biasing force of the spring (49) act on the valve element (61) of the lubrication control mechanism (60); however, the former force becomes greater than the latter force when the high-low pressure difference reaches the predetermined value. Consequently, the valve element (61) moves toward the radial direction outside in the main body path (51) and changes position to the first position (FIG. 4).

As a result, the first small-aperture (54), which has been closed up to that time (see FIGS. 2 and 5), is opened and the first pathway (50*a*) is opened. Consequently, a part of the refrigerant passing through the main lubrication path (36) within the drive shaft (34) is supplied, by way of the first small aperture (54), to the press-contact surfaces (55) of the scrolls (21, 22). Accordingly, a force pushing back the orbiting scroll (22) in opposition to the pressing force of the orbiting scroll (22) against the fixed scroll (21) acts, thereby preventing the pressing force from becoming excessive. In addition, if an annular groove is formed in the upper surface of the orbiting scroll (22), this ensures that a push-back force acts and facilitates designing for push-back force adjustment by adjusting its area.

Adversely, when, for example, the decrease in high-level pressure by a change in operating condition causes the high-low pressure difference to change in the direction in which it diminishes, the pressure of refrigerating machine oil at the press-contact surfaces subsides and the push-back force subsides. Further, when the high-low pressure difference becomes below the predetermined value, the valve element (61) changes position to the second position (FIG. 5) from the relationship between forces acting on the valve element (61) and, as a result, the first small aperture (54) is closed. At this time, the second small aperture (55) is opened, and the second pathway (50) is opened. Consequently, when the high-low pressure difference is equal to or less than the predetermined value, there is a supply of refrigerating machine oil to the press-contact surfaces through the low-level pressure space (S1), so that no push-back force will act. This prevents deficiency in pressing force of the orbiting scroll (22) against the fixed scroll (21).

Furthermore, when the valve element (61) assumes the first position, refrigerating machine oil is supplied to the press-contact surfaces of the fixed and orbiting scrolls (21, 22) directly from the main body passageway (51) and the press-contact surfaces are lubricated. Additionally, when the valve element assumes the second position, refrigerating machine oil is supplied, via the first space, to the press-contact surfaces and the press-contact surfaces are lubricated. As a result of this, the orbiting scroll (22) performs stable operations without mal-lubrication, regardless of the variation in high-low pressure difference.

EFFECTS OF EMBODIMENT

As has been described, in accordance with the present embodiment, it is arranged such that the orbiting scroll (22) is pressed against the fixed scroll (21) by an adequate pressing force when the high-low pressure difference is small, thereby preventing the orbiting scroll (22) from overturning. On the other hand, when the high-low pressure difference becomes great, refrigerating machine oil is introduced to the press-contact surfaces of the fixed and orbiting scrolls (21, 22) by the operation of the lubrication control mechanism (60), thereby preventing the pressing force from becoming excessive.

Accordingly, when the high-low pressure difference is small, overturning of the orbiting scroll (22) due to the lack of pressing force does not occur, thereby preventing the drop in efficiency due to refrigerant leakage. In addition, when the high-low pressure difference is great, mechanical loss caused by an excessive pressing force is avoided. As a result, it becomes possible to perform effective operations in every high-low pressure difference range from the time when the high-low pressure difference is small to the time when the high-low pressure difference is great.

Furthermore, the high-level pressure of the second space (S2) is used to press the orbiting scroll (22) against the fixed scroll (21) for preventing overturning of the orbiting scroll (22) and the pressing force is suppressed by introducing a high-level pressure fluid within the compressor (1) to the press-contact surfaces according to the variation in highlow pressure difference, thereby making it possible to prevent mechanical loss while making effective utilization of the pressure within the compressor (1).

Additionally, the two pathways (50*a*, 50*b*) of the press-contact surface lubrication path (50) formed in the orbiting scroll (22) so as to communicate with the main lubrication path (36) within the drive shaft (34) are switched by the lubrication control mechanism (60) activated by the difference in pressure between the low-level pressure space (S1) and the high-level pressure space (S2) within the casing (10). This allows the lubrication control mechanism (60) to be a simple, piston type construction, thereby preventing the whole construction of the lubrication control mechanism (60) from becoming complicated.

Furthermore, the lubrication path (50) is used for high-level pressure introduction to the press-contact surfaces, which makes it possible to provide a more simplified construction in comparison with a case where the frame (23) is provided with a special high-level pressure introduction pathway and a control valve. Therefore, it is also possible to hold down costs.

Additionally, although the above description makes no mention of the change in low-level pressure, the present embodiment is able to provide the same working and effects even when counting in the change in low-level pressure.

The present invention may employ the following construction for the foregoing embodiment.

For example, the foregoing embodiment employs the lubrication control mechanism (60), composed of the piston-like valve element (61), for selectively supplying lubricant to the press contact surfaces or to the first space from the main lubricant path (36); however, the concrete construction of the lubrication control mechanism (60) may be changed as required.

INDUSTRIAL APPLICABILITY

As has been described, the present invention is useful for scroll compressors.

What is claimed is:

1. A scroll compressor comprising:

a casing housing a compression mechanism including a fixed and orbiting scrolls having respective involute wraps which matingly engage with each other and respective press-contact surfaces which press-contact each other in an axial direction;

a drive mechanism coupled, through a drive shaft to said orbiting scroll; and a press-contact surface lubrication path which is formed in said orbiting scroll so as to communicate with said press-contact surfaces from a main lubrication path formed in said drive shaft, said press-contact surface lubrication path comprising a first pathway which communicates with said press-contact surfaces from inside of said orbiting scroll, a second pathway which communicates with said press-contact surfaces through a low-level pressure space of said casing, and a lubrication control mechanism which opens said first pathway and closes said second pathway when a difference between a high-level pressure and a low-level pressure within said casing exceeds a predetermined value, and which closes said first pathway and opens said second pathway when said high-low pressure difference is equal to or less than said predetermined value.

2. The scroll compressor of claim 1, wherein:

said press-contact surface lubrication path comprises a main body passageway formed inside of said orbiting scroll so as to open to said main lubrication path and to said low-level pressure space's side, a first branch passageway which communicates with said press-contact surfaces of said scrolls from said main body passageway and a second branch passageway which communicates with said low-level pressure space from said main body passageway, said lubrication control mechanism comprises a valve element which is provided movably within said main body passageway, and said valve element travels to a first position when said high-low pressure difference exceeds said predetermined value so that said first branch passageway is opened and said second branch passageway is closed, and said valve element travels to a second position when said high-low pressure difference is equal to or less than said predetermined value so that said first branch passageway is closed and said second branch passageway is opened.

3. The scroll compressor of claim 2, wherein:

said lubrication control mechanism comprises biasing means for applying a biasing force to urge said valve element to said second position within said main body passageway, and the biasing force of said biasing means is set such that said valve element is held at said second position when said high-low pressure difference is equal to or less than said predetermined value, and such that said valve element is allowed to travel to said first position when said high-low pressure difference exceeds said predetermined value.

* * * * *